US007318288B2

(12) United States Patent
Zahedi et al.

(10) Patent No.: US 7,318,288 B2
(45) Date of Patent: Jan. 15, 2008

(54) APPARATUS AND METHOD USING AN ELECTRIFIED FILTER BED FOR REMOVAL OF POLLUTANTS FROM A FLUE GAS STREAM

(76) Inventors: Karim Zahedi, P.O. Box 590116, Newton Center, MA (US) 02459; Arya Zahedi, P.O. Box 590116, Newton Center, MA (US) 02459

( * ) Notice: Subject to any disclaimer, the term of this patent is extended or adjusted under 35 U.S.C. 154(b) by 0 days.

(21) Appl. No.: 11/377,871

(22) Filed: Mar. 17, 2006

(65) Prior Publication Data

US 2007/0214676 A1 Sep. 20, 2007

(51) Int. Cl.
*F26B 7/00* (2006.01)

(52) U.S. Cl. ..... 34/381; 34/90; 34/138; 34/157; 95/73; 96/74

(58) Field of Classification Search ..... 34/90, 34/137, 138, 381, 157; 95/73; 96/74
See application file for complete search history.

(56) References Cited

U.S. PATENT DOCUMENTS 4,349,367 A * 9/1982 Krumwiede ..... 65/27
4,431,405 A * 2/1984 Eatherton ..... 432/72
6,974,494 B1 * 12/2005 Zahedi ..... 95/73
2005/0229780 A1 * 10/2005 Spink et al. ..... 95/65

* cited by examiner

*Primary Examiner*—S. Gravini
(74) *Attorney, Agent, or Firm*—Miles & Stockbridge P.C.

(57) ABSTRACT

A pollution abatement apparatus comprises an electrified filter bed preceded by a cyclonic mix chamber to remove wood fines and fly ash in a flue gas stream from a wood chip dryer heated by hot gas from an energy system that includes a wood waste combustor. The cyclonic mix chamber has dual inlets, one supplied with flue gas from the dryer and the other supplied with hot gas from the energy system.

8 Claims, 4 Drawing Sheets

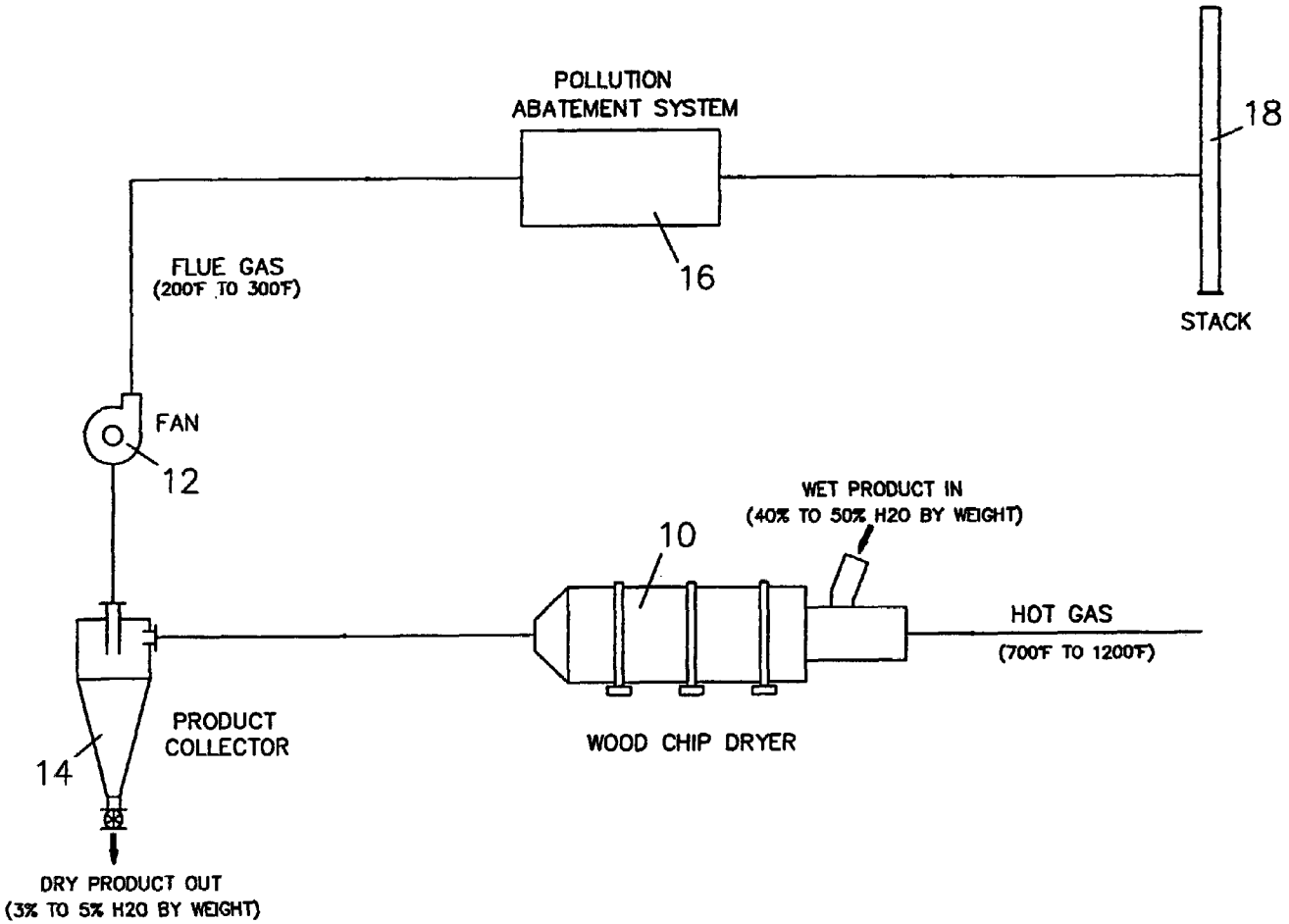
FIG. 1: TYPICAL WOOD CHIP DRYER ARRANGEMENT
PRIOR ART

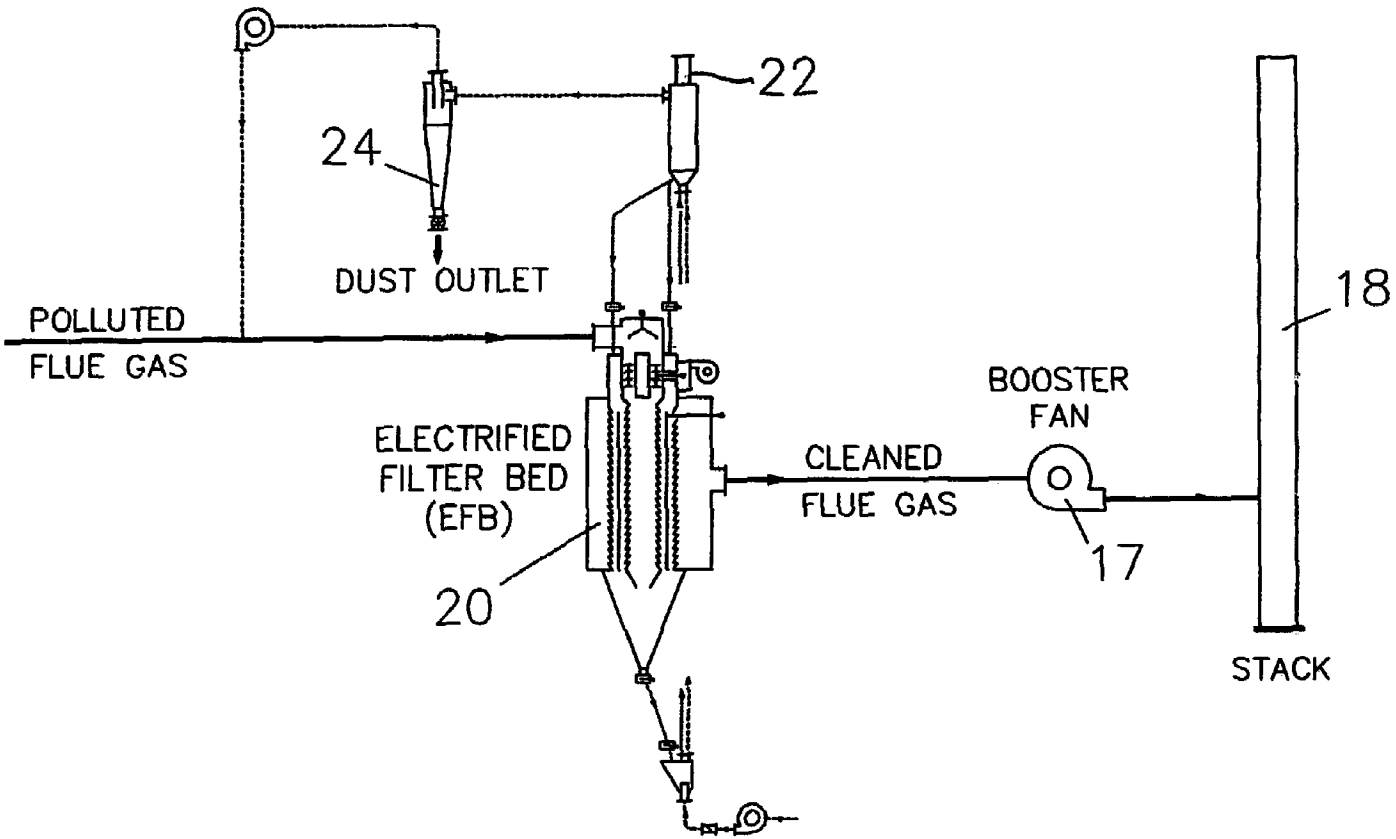
FIG. 2: EFB SYSTEM
PRIOR ART

APPARATUS AND METHOD USING AN ELECTRIFIED FILTER BED FOR REMOVAL OF POLLUTANTS FROM A FLUE GAS STREAM

BACKGROUND OF THE INVENTION

This invention is concerned with the removal of particulate pollutants from a flue gas stream. More particularly, the invention is concerned with the utilization of an Electrified Filter Bed (EFB) and a cyclonic mix chamber for removal of combustible and inert particulate pollutants in a flue gas stream from a wood chip dryer in a plant producing composite board, for example.

As shown in FIG. 1, to produce wood panelboard and other lumber or timber products (e.g., particleboard, waferboard, oriented strand board, oriented strand lumber, chipboard, etc.) a raw feed product, referred to hereinafter as wood chips, must first be dried before it is pressed with binding resin into boards and lumber. The inherent moisture content of the raw feed is typically in the range of 40%-50% by weight and must be reduced to a level of approximately 3%-5% for a satisfactory final product. This reduction in moisture content is achieved by introducing the raw feed into a rotating kiln or dryer 10, which operates at appreciably high temperatures by the continuous flow of hot gas.

The hot gas used to dry the wood chips is conventionally generated in an energy system (later described with reference to FIG. 4) by burning waste wood byproducts, such as bark, sawdust, or the like, in a wood waste combustor (burner). A portion of hot gas derived from the combustor is directed to the gas inlet of the dryer, while the remaining volume of hot gas is introduced to a heat exchanger, which provides thermal oil or steam that serves to power the plant's operation. The output of the heat exchanger is supplied to a collector that separates out some of the dry particulate combustion products. A hot gas stream from the collector is then mixed with the gas supplied from the combustor to the dryer, the mixed gas stream being at a temperature of about 700° F.-1200° F.

The well-mixed hot gas stream passes through the dryer to reduce the moisture content of the wood chips, as previously described. When the raw feed is sufficiently dried, a gas stream from the dryer, containing the dried wood chips, is supplied to a cyclonic product collector 14, which removes the dry wood chip product. A fan 12 supplies the flue gas stream from the collector 14 to a pollution abatement system 16. At the point of exit from the dryer, the flue gas is at an exhaust temperature of roughly 200° F.-300° F., much of the initial thermal energy having been expended in the drying process. The dried wood chips released from the cyclone 14 are homogenized and coated with a binding resin, ultimately to be pressed into panel board, for example, in a downstream process.

The drying operation gives rise to three major types of pollutants, namely, inert fly ash, particulate wood fines, and Volatile Organic Compounds (VOCs). Fly ash is a very fine byproduct of wood fuel combustion, which occurs in the wood waste combustor. Wood fines are small wood fibers that are generated as a result of mechanical agitation in the dryer. Because of their small size, wood fines and fly ash, both of which act as dry dust particles, are not able to be collected by the cyclone product collector 14. The third type of pollutants, VOC's, is derived from wood chips during the drying process, and includes terpenes, isoprenes, resins, and fatty acids. The present invention concentrates on the removal of inert fly ash and combustible wood fines, as described later.

Increasingly stringent environmental regulations require more highly controlled operation of pollution abatement systems. This means that there can be no bypass, or only minimal bypass, of the pollution abatement system. Pollution abatement equipment cannot be taken off-line for maintenance without concurrently terminating critical plant production processes. Prior to current pollution abatement regulations, plants routinely continued to operate wood production processes while pollution abatement systems were off-line for repair and/or inspection. Recent regulations prohibit such practices, and it has become essential that the uptime of the pollution abatement systems be maximized. Optimization of the pollution abatement systems is necessary to provide less downtime, greater production, greater revenue, and a substantial benefit to the environment.

For some time, Electrified Filter Bed (EFB) systems have been used in pollution abatement systems for the removal of particulate in flue gas streams from wood chip dryers. See, for example, U.S. Pat. No. 6,974,494 issued Dec. 13, 2005. Such a system, shown in FIG. 2, is well known and will be described briefly.

In the EFB 20, pollutant particles are given an electrostatic charge, by means of a corona ionizer type device, and are then deposited onto the surface of filter media (e.g., pea sized gravel) in the filter bed. An electrode in the filter bed polarizes the filter media and hence provides caps of positive and negative charge. The electrical force between the charged pollutant particles and the polarized filter media results in effective capture of the pollutant particles on the filter media.

Cleaned, particulate-free, gas exits the EFB and is discharged into the atmosphere by a booster fan 17 and a stack 18. The filter media coated with pollutants is removed from the EFB and is cleaned externally by the use of a pneumatic transport system. Filter media and collected pollutant particles are conveyed pneumatically from the bottom of the EFB system to the top of the system, where the pollutant particles are separated from the filter media via physical impaction using a bounce pad 22. The cleaned filter media are returned to the filter bed for further use, while lighter dust particulate pollutants are carried out via transport air lines and collected in a small collector 24, such as a bag filter or a super efficient cyclone.

Two problems have imposed limitations on the use of EFB units for the removal of particulate pollutants in flue gas streams from wood chip dryers, namely:

1. The inability to use the EFB to clean hot gases from the energy system during downtime of the dryer system for maintenance and repair.
2. The length of time required to preheat the EFB for proper operation.

These problems will now be elucidated by reference, for example, to an Orientated Strand Board (OSB) plant equipped with a direct-heated rotary dryer, which must be taken off-line for repair or maintenance. Because the energy system requires complete combustion of all wood fuel within the system and cannot similarly be taken off-line, the hot gases from the energy system have often been directly expelled into the atmosphere along with significant concentrations of pollutants, which is an unacceptable practice. Adding a special pollution abatement system to control emissions in the event of dryer shut-downs is cost prohibitive and cannot be employed.

It would be highly advantageous to utilize existing EFB systems, installed for abatement of dryer flue gas pollutants, to treat energy system flue gas during the dryer downtime. However, the high temperature (500° F.-600° F.) of the energy system flue gas has prevented such use of the EFB systems. The EFB accumulates considerable amounts of wood fines that spontaneously combust at temperatures in excess of 425° F. in the presence of oxygen. Thus, the use of EFB systems to treat energy system flue gases during dryer downtime would run the risk of fire in the EFB.

The lengthy time required for start-up of the EFB is also a problem, as noted earlier. Typically, when an OSB dryer is equipped with EFB modules, more than 100 tons of gravel is loaded into each EFB module, with some plants incorporating systems with as many as eight EFB modules. Since the EFB units must be pre-heated to a temperature above the water dew point, it has been necessary for the dryer to operate in an idle mode, without a wood chip load, with hot gas running through the dryer and subsequently through the EFB. For large volumes of gravel, this requires many hours (e.g., 2-4 hours) of preheating, during which time no production occurs.

If the plant commences production before proper preheating of the EFB (e.g., after only 15-20 minutes of preheating), large volumes of moist flue gas are introduced into the relatively cold (e.g., less than 150° F.) gravel bed filter, causing water condensation. As the gravel bed heats up, the water evaporates, but localized gravel plugging in various parts of the filter bed will occur. This problem may not manifest itself immediately, but ultimately gravel flow through the filter bed becomes non-uniform, and the condition worsens and eventually causes very high pressure drop across the EFB filter. When this occurs, the EFB must be taken off-line, purged of gravel and cleaned before it can be put back into operation. Such occurrences require many hours of downtime and result in significant production losses.

BRIEF DESCRIPTION OF THE INVENTION

The present invention provides an apparatus and method that solve both of the problems discussed above. More particularly, in a preferred embodiment the invention uses a cyclonic mix chamber, which receives a dryer flue gas stream and a gas stream from the energy system, to remove combustible wood fines, so that the gas stream supplied to an EFB contains inert fly ash and is substantially free of combustible material. Further, when the dryer is off-line for maintenance or repair, for example, the flue gas stream from the dryer to the cyclonic mix chamber is interrupted, so that the EFB can be preheated rapidly with hot gas directly from the energy system, without risk of fires in the EFB. In addition, the EFB can properly treat hot gas from the energy system for particulate removal.

BRIEF DESCRIPTION OF THE DRAWINGS

The invention will be further described in conjunction with the accompanying drawings, which illustrate a preferred (best mode) embodiment, and wherein:

FIG. 1 shows, diagrammatically, a typical prior art wood chip dryer arrangement with a pollution abatement system;

FIG. 2 shows, diagrammatically a typical prior art electrified filter bed system;

DETAILED DESCRIPTION OF THE INVENTION

Underlying the present invention is a detailed investigation that was conducted, aimed at solving the problems discussed earlier. An analysis was conducted of the particulate collected by an EFB in a typical dryer operation. It was determined that about 30%-40% (by weight) of the particulate collected by the EFB was combustible wood fines, while the remaining 60%-70% was inert (essentially non-combustible) fly ash. As mentioned earlier, the source of wood fine particulate is the dryer, and the source of fly ash is the combustor in the energy system. Examination of the size distribution of total particulate collected showed a bimodal distribution, with two distinct classes of particulate. The heavier wood fines were found to have a mean diameter of approximately 20 microns, while the lighter fly ash exhibited a mean diameter of approximately 3 microns.

Figure 3C:
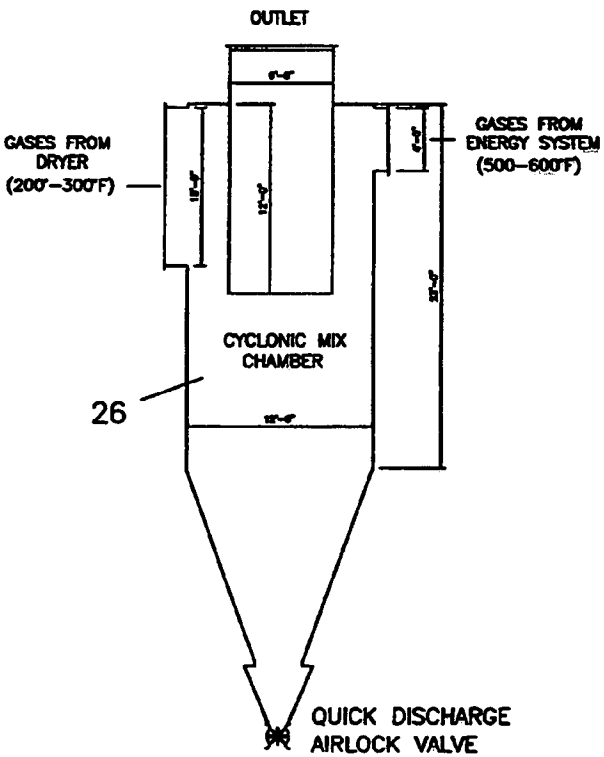
FIGS. 3A, 3B, and 3C show, respectively, an elevation view, a top plan view and a cutaway view of a cyclonic mix chamber used in the invention.
Figure 3B:
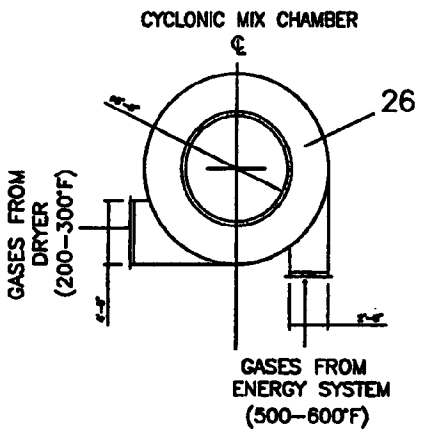
Figure 3A:
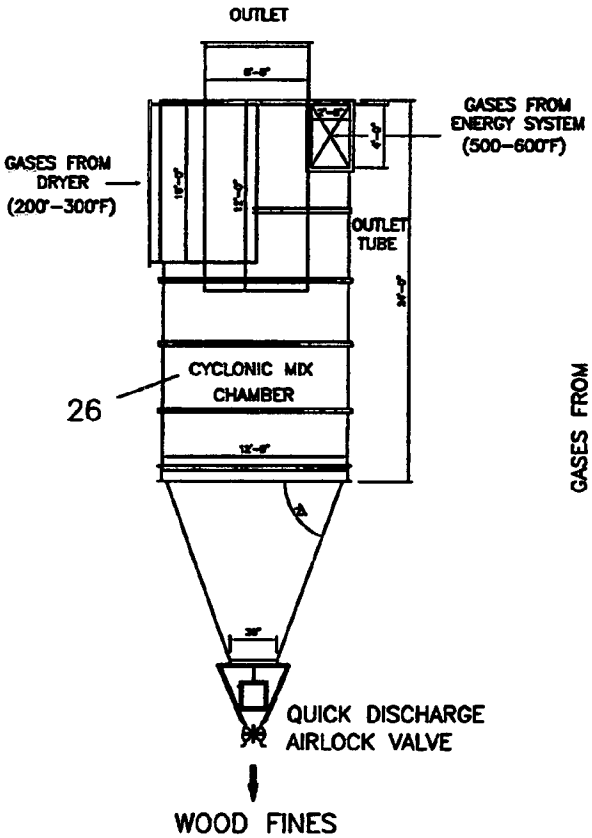
Figure 4:
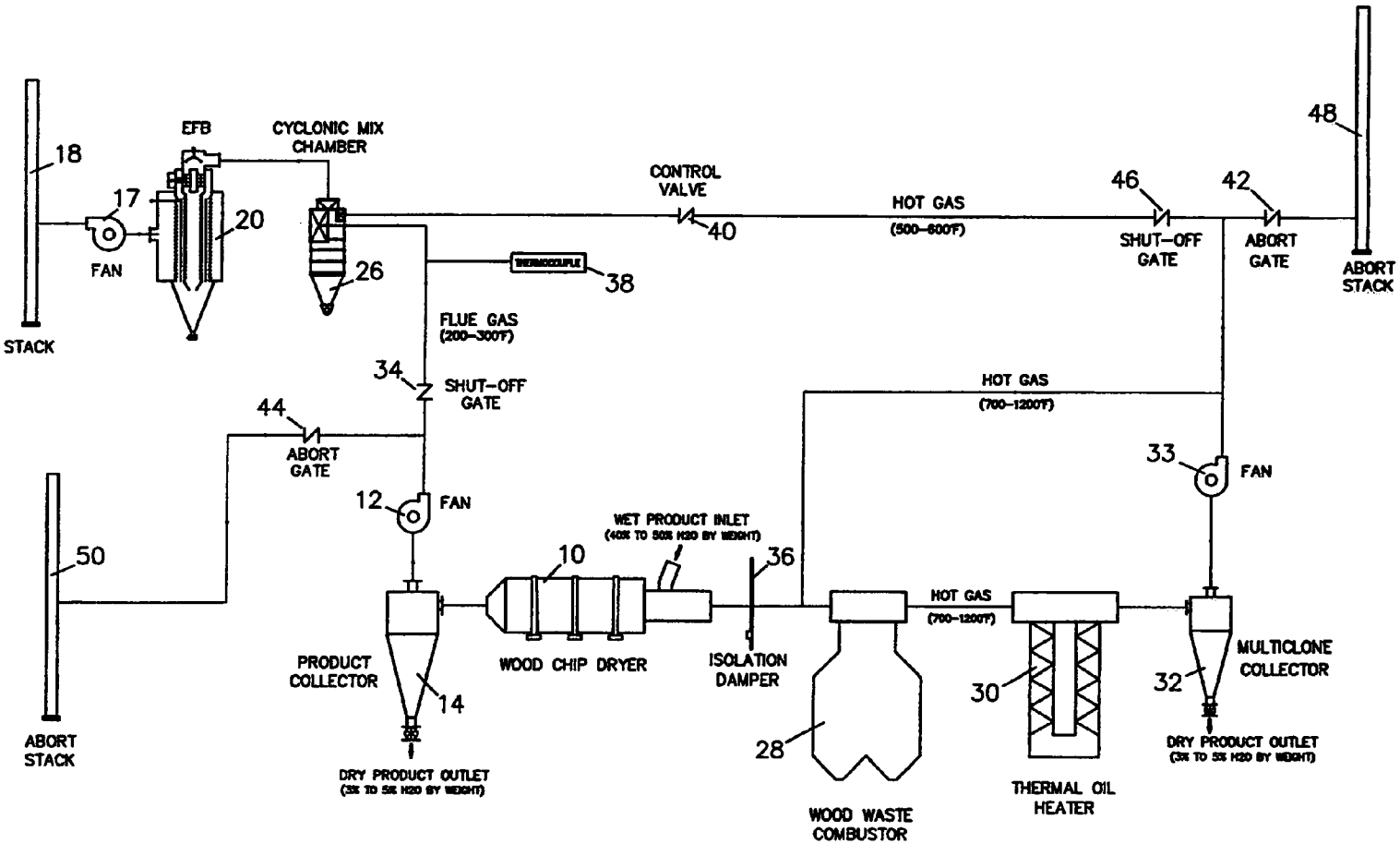
FIG. 4 shows, diagrammatically, apparatus of the invention including the wood chip dryer arrangement of FIG. 1, the EFB system of FIG. 2, and the cyclonic mix chamber of FIGS. 3A, 3B and 3C, in conjunction with an energy system that includes a wood waste combustor, a thermal oil heater, and a multiclone collector.

This investigation led to the development and implementation of an apparatus using a cyclonic mix chamber positioned upstream of the EFB for receiving the flue gas stream from the dryer, as shown in FIG. 4. A cyclonic mix chamber 26 suitable for the purposes of the invention as shown in FIGS. 3A, 3B and 3C. The cyclonic mix chamber is designed to provide a pressure drop of 3" and an inlet velocity of 50 ft/sec. This arrangement has proven effective to collect the heavier wood fines with high efficiency while passing the lighter fly ash to the EFB for electrostatic collection. Moreover, it has been found that the amount of wood fines accumulated in the EFB is minimal, and for the purposes of the invention it is negligible.

Samples of the particulate matter collected by the cyclonic mix chamber and the EFB were tested for combustibility in an oven at a temperature of 400° F. to 550° F. The samples from the cyclonic mix chamber exhibited combustion at these temperatures, while samples collected from the EFB remained intact without indication of combustion. Furthermore, upon exposure to a rapid ignition source, samples from the cyclonic mix chamber instantaneously began to smolder and burn, while samples from the EFB did not exhibit such behavior even upon prolonged exposure to the ignition source.

As shown in FIGS. 3A, 3B, and 3C, the cyclonic mix chamber is designed to have two independent tangential inlets, located, as shown in the figures, so as to spin input gas streams in the same direction (which can be either clockwise or counterclockwise) to allow the cyclonic mixing of the two inlet gas streams. In the invention, one of the gas streams is a relatively cool moist dryer gas stream, which contains combustible wood fines, and the other gas stream is a relatively hot gas stream from the energy system, which contains inert fly ash. The hotter and cooler gases mix well in the cyclonic mix chamber without producing hot spots on the walls and system surfaces.

In a typical design, the cyclonic mix chamber mixes 120,000 cfm of flue gas from the dryer at a temperature of about 230° F. with 30,000 cfm of hot gas from the energy system at a temperature of about 550°, providing a temperature of about 275° F. in a flue gas stream from the cyclonic mix chamber to the inlet of the EFB. In this design, the sizes of the inlets to the cyclonic mix chamber are 4 ft by 10 ft for the dryer duct connection and 2.5 ft by 4 ft for the hot gas connection. The inlets to the cyclonic mix chamber are arranged at 90° to one another to spin the respective gas streams counterclockwise. The mix chamber outlet duct is 6 ft in diameter. The body of the mix chamber is 24 ft tall, with the outlet duct inserted into the body by 12 ft. The bottom of the cyclonic mix chamber is outfitted with a quick discharge airlock valve to empty wood fines, thereby preventing substantial retention of collected particulate material.

Because the cyclonic mix chamber collects combustible particulate wood fines with high efficiency, it is now possible to preheat the EFB rapidly with hot gases discharged from the energy system, without the risk of causing fires within the EFB. As shown in FIG. 4, the energy system includes a wood waste combustor 28, a thermal oil heater 30, a multiclone collector 32, and a fan 33. A portion of the hot gas from the wood waste combustor is directed toward the gas inlet of the wood chip dryer 10. A remaining portion of the hot gas from the wood waste combustor passes through a heat exchanger constituted by the thermal oil heater and through a multiclone collector 32, which removes some dry products of combustion from the wood waste combustor, but not fly ash. A portion of the gas stream exhaust from the collector 32 is mixed with the hot gas directed from the combustor 28 toward the gas inlet of the wood chip dryer. Another portion of the gas stream from the collector 32 provides a flow of hot gas to the hot gas inlet of the cyclonic mix chamber 26.

During the preheat cycle, gas from the energy system is applied to the EFB through the cyclonic mix chamber 26, while a shut-off gate valve 34 in the path to the cyclonic mix chamber from the wood chip dryer 10 is closed. The gas supplied from the energy system, which is in the range of 500° F.-600° F., heats the gravel bed of the EFB 20 in less than one-half hour, thereby significantly reducing the time required for the EFB to be ready for the production process to begin. This feature of the invention optimizes operation of the EFB without sacrificing valuable production time. Furthermore, it increases the uptime of the EFB and reduces maintenance problems associated with inadequate preheating of the EFB prior to production start-up.

Another feature of the invention allows treatment of gases from the energy system during dryer downtime, thereby providing an effective and economical approach to preventing the release of untreated emissions from the energy system during dryer downtime. In accordance with this feature of the invention, the dryer 10 is taken off-line, and an isolation damper 36 between the energy system and the dryer is closed. Hot gases from the energy system, instead of being expelled directly into the atmosphere, are supplied to the EFB 20 via the cyclonic mix chamber. The EFB can handle these hot gases and properly treat them for fly ash removal without experiencing spontaneous internal fires.

A further feature of the invention is the ability to prevent condensation in the EFB. On occasion, moist flue gases from the dryer fall below the dew point during normal dryer operations. This circumstance can be caused by fluctuations in the feed rate to the dryer, fluctuations in the temperature of gas supplied to the dryer, or other variables associated with the dryer. The provision of the cyclonic mix chamber 26 upstream of the EFB 20 allows the introduction of controlled volumes of hot gas from the energy system into the dryer flue gas stream to raise the flue gas temperature to a point safely above the dew point and prevent condensation in the EFB. A temperature sensor, such as a thermocouple 38, measures the temperature of the dryer flue gas stream. Once it detects a steady-state low temperature below 250° F., it automatically opens a control valve 40 to provide a flow of hot gas from the energy system that is sufficient to raise the temperature of the gas supplied to the EFB to a level that avoids condensation.

In the event of an emergency situation, normally closed abort gate valves 42 and 44 can be opened, shut-off gate valves 34 and 46 can be closed, and the output gases from the wood chip dryer and the energy system can be released through abort stacks 48 and 50.

While a preferred embodiment of the invention has been shown and described, changes can be made without departing from the principles and spirit of the invention, the scope of which is defined in the claims which follow.

What is claimed is:

1. Apparatus comprising:

a product dryer heated by a hot gas from a combustor; and a pollution abatement system that removes particulate pollutants in flue gas from the dryer containing combustible particulate pollutants and inert particulate pollutants, wherein:

the pollution abatement system includes an electrified filter bed preceded by a cyclonic mix chamber that mixes flue gas from the dryer with gas from the combustor and removes the combustible particulate pollutants from the flue gas, and that passes a gas stream containing the inert particulate pollutants to the electrified filter bed, which removes the inert particulate pollutants from the gas stream, wherein the electrified filter bed includes a vessel containing a granular filter medium, an ionizer that imparts electric charges to the inert particulate pollutants in the gas stream, and electrodes that apply a polarizing electric field to the granular filter medium, wherein the dryer is a wood chip dryer, the combustible particulate pollutants are wood fines from the dryer and the inert particulate pollutants are fly ash from the combustor, and wherein the temperature of gas input to the cyclonic mix chamber from the combustor is substantially higher than the temperature of flue gas input to the cyclonic mix chamber from the dryer.

2. Apparatus according to claim 1, wherein the cyclonic mix chamber has two tangential inlets arranged at 90° from one another, one of which receives flue gas from the dryer and the other which receives gas from the combustor.

3. Apparatus according to claim 1, wherein the apparatus includes a valve arrangement by which gas from the combustor is supplied to the cyclonic mix chamber in the absence of a supply of flue gas to the cyclonic mix chamber from the dryer.

4. A method of removing particulate pollutants in a flue gas stream from a wood chip dryer heated by hot gas from a combustor, wherein the flue gas stream contains wood fines as combustible particulate pollutants and fly ash from the combustor as inert particulate pollutants, said method comprising:

providing a pollution abatement system that includes an electrified filter bed preceded by a cyclonic mix chamber that mixes flue gas from the dryer with gas from the combustor and removes the combustible particulate pollutants from the flue gas, and that passes a gas stream containing the inert particulate pollutants to the electrified filter bed, which removes the inert particulate pollutants from the gas stream, wherein the electrified filter bed includes a vessel containing a granular filter medium, an ionizer that imparts electric charges to the inert particulate pollutants in the gas stream, and electrodes that apply a polarizing electric field to the granular filter medium, and wherein the temperature of gas input to the cyclonic mix chamber from the combustor is substantially higher than the temperature of flue gas input to the cyclonic mix chamber from the dryer.

5. A method according to claim 4, wherein the electrified filter bed is preheated by gas from the combustor in the absence of a flue gas stream from the dryer.

6. A method according to claim 4, wherein the flue gas stream from the dryer is interrupted and gas from the combustor is supplied to the electrified filter bed.

7. A method according to claim 4, wherein the temperature of the flue gas stream from the dryer is monitored and the stream of gas from the combustor is adjusted so that the temperature of the flue gas stream passed through the electrified filter bed is maintained at a level that prevents condensation of water in the electrified filter bed.

8. A method according to claim 4, wherein flue gas from the dryer and gas from the combustor are introduced to the cyclonic mix chamber tangentially at 90° from one another.

* * * * *